US005526979A

United States Patent [19]

Mann

[11] Patent Number: 5,526,979

[45] Date of Patent: Jun. 18, 1996

[54] SECURITY MAILBOX WITH OUTGOING MAIL POCKET

[76] Inventor: Billy L. Mann, 1022 Dora Ave., Yuma, Ariz. 85364

[21] Appl. No.: 419,022

[22] Filed: Apr. 10, 1995

[51] Int. Cl.[6] ..... B65D 91/00

[52] U.S. Cl. ..... 232/33; 232/47

[58] Field of Search ..... 232/17, 33, 45, 232/47–52

[56] References Cited

U.S. PATENT DOCUMENTS

| | | | |
|---|---|---|---|
| 684,004 | 10/1901 | Stevenson | 232/33 |
| 830,231 | 9/1906 | Homme | 232/47 |
| 1,128,919 | 2/1915 | Utterback | 232/33 |
| 1,202,251 | 10/1916 | Van Dorn | 232/45 |
| 3,880,344 | 4/1975 | Earle | 232/17 |

*Primary Examiner*—Flemming Saether

[57] ABSTRACT

A security mailbox with an outgoing mail pocket. Incoming mail is deposited through a hinged upper door, thereby dropping to and being contained in the bottom of the box. The upper door cooperates with an internal wedge to form a physical block that prohibits access to deposited mail from the upper door. Deposited incoming mail is instead accessible only at the back of the box through a locked access door. An outgoing mail pocket is formed on the inside of the upper door. The mail pocket is formed below the upper door such that mail being thrown into the box does not get caught on the outgoing mail pocket. The substantially rectangular box is made of heavy steel and stands upright directly on the ground, used preferably in rural settings.

3 Claims, 1 Drawing Sheet

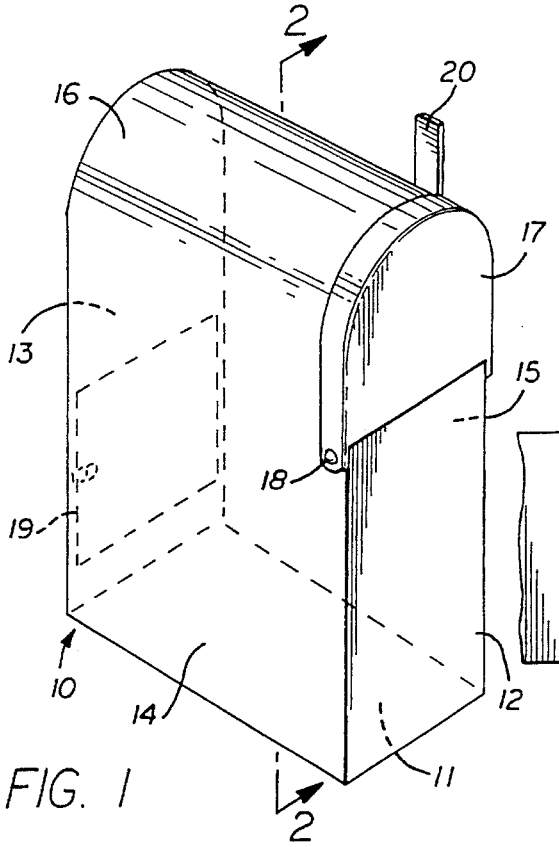
FIG. 1
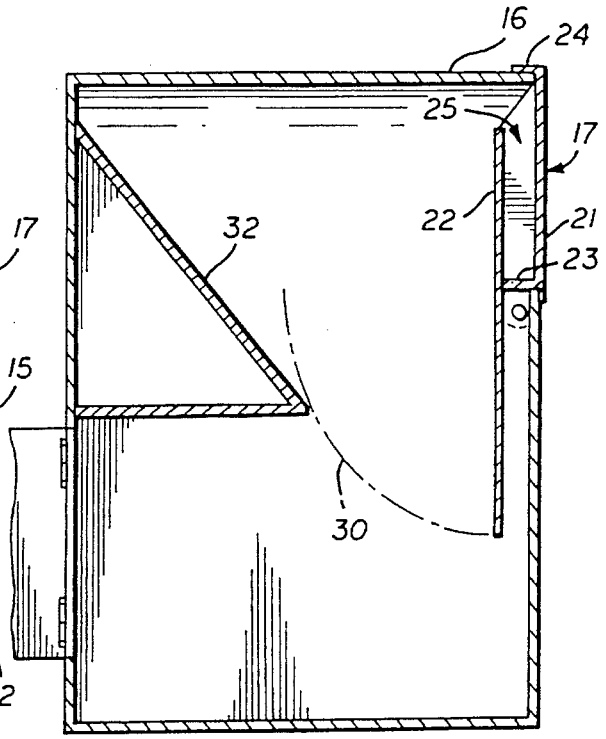
FIG. 2
FIG. 3
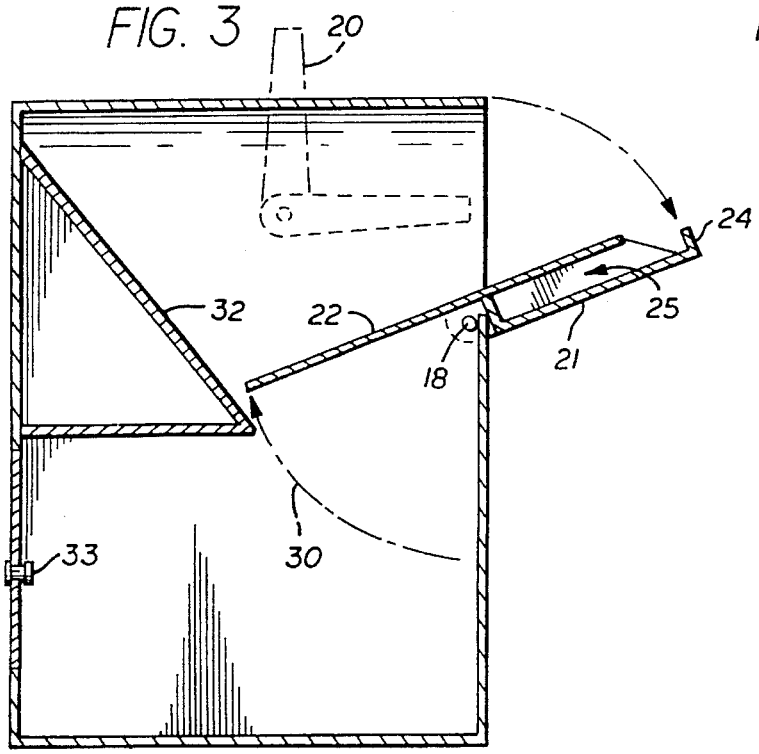
FIG. 4
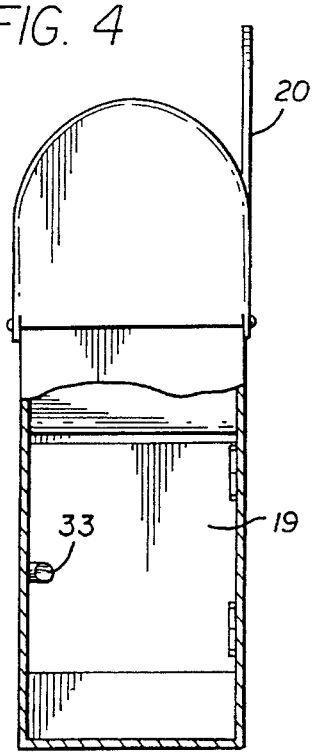

SECURITY MAILBOX WITH OUTGOING MAIL POCKET

BACKGROUND OF THE INVENTION

This invention relates generally to an upright mailbox, and more particularly to a residential security mailbox designed to prevent unauthorized access to the deposited mail. The theft of personal mail is one of the most insidious crimes threatening America today. For example, a new credit card may be stolen by a mail thief and the true owner will have no idea the credit card has been stolen until a large bill arrives, and the battle with the credit card company begins. The theft of social security checks is another common occurrence, the thefts facilitated by the knowledge that social security checks are sent out periodically at a publicly-known interval.

To steal the mail, typically a thief will simply reach by hand into a mailbox and remove the mail. Alternatively, a snake-like tool may be used to retrieve the mail. The present device is a security mailbox designed to prevent the theft of mail by these means.

Security mailboxes are known in the art. Unfortunately, these mailboxes do not completely prohibit access to the deposited mail, in main part because they simply do not physically close the gap between the incoming mail door and the bottom of the container with a physical barrier. Furthermore, residential security mailboxes need to be convenient for the mailman and the person retrieving the mail. In particular, there must be an outgoing mail compartment that is easily accessible by both parties. The present device has attributes that solve these problems by improving upon the prior art.

In the prior art, U.S. Pat. No. 5,207,377 discloses a deflectable mailbox having a hinged door for depositing incoming mail, a separate shelf for outgoing mail, and a locking access door in the rear wall of the box. When open, the incoming mail door extends horizontally across the entire width of the interior of the box and abuts a plastic support member at the rear of the box which supports the shelf in a horizontal position. This support member is designed to yield to pressure, however, to allow the door to close. The device is disadvantageous in that the plastic support member is designed to yield to pressure from the door, thereby allowing access to the deposited mail in the compartment below while the door is open. Furthermore, the outgoing mail shelf congests the area for depositing incoming mail.

U.S. Pat. No. 3,144,985 discloses a box for stacking mail face up as it is deposited into the mailbox. The mailbox has a hinged door that swings into a horizontal position when opened to prevent access into the container. A vertical plate is installed as a fixed guard inside the box to prohibit access to the inside of the box. This fixed guard, however, does not meet the distal edge of the door, so that a hand or tool may be inserted into the box between the door and the guard and mail stolen. The device does not have an outgoing mail compartment.

U.S. Pat. No. 527,799 discloses a mailbox having a spring-biased mail door that cooperates with a pivoting horizontal mail shelf. When the door to the mailbox is open, the shelf is held in a horizontal position so that the inside of the box cannot be accessed. When the door is closed, the shelf tilts and lets the deposited mail slide to the bottom of the box. However, the lower compartment can be accessed when the door is only partially open. Furthermore, an outgoing mail compartment is not available.

It is an object of this invention to provide a mailbox for residential use that completely prohibits unauthorized access to the deposited mail. It is a further object to prevent such access by physical means, namely a design of cooperating elements within the box that block a hand or tool from being inserted through the incoming mail opening. Another object of this invention is to provide a security residential mailbox with a convenient outgoing mail pocket.

BRIEF SUMMARY OF THE INVENTION

This invention is a security mailbox for home use. The mailbox may be used in urban or suburban areas, and the preferred use is in rural settings where mailbaoxes are often several hundred yards from the home—too far away for visually guarding the deposited mail. Its purpose is to prevent mail from being stolen once the postman has delivered it to the box. The mailbox comprises three main elements: the incoming mail mechanism design, the outgoing mail pocket, and the locking access door.

The box itself is heavy steel, substantially rectangular and stands upright on the ground. The incoming mail mechanism design uses two cooperating elements: an upper door and a wedge. The upper door swings from a vertical to horizontal position, and is in the vertical position when closed. The upper door is attached to the front wall near the door's center axis so that when it is opened, the bottom of the door travels upwards in an arc until it is in approximately a horizontal position within the box, thereby forming a shelf. At this horizontal position, the distal edge of the shelf meets a wedge-shape block at the back of the box so that a physical barrier exists, and the inside of the box cannot be accessed from the front.

To deposit mail, the upper door is opened, mail is placed on the shelf, and the door is released back to its vertical position. The mail falls to the bottom of the box, where it is accessible only through the back of the box through a lower door. The door is locked and may be opened with a key or combination lock.

The upper door also functions as a pocket for outgoing mail. The pocket is formed by two panels attached with a horizontal crosspiece, one of the panels being the shelf for incoming mail and the other panel being an outside panel that encloses the box. The pocket is formed below the incoming shelf such that mail being thrown into the box does not get caught on the outgoing pocket.

BRIEF DESCRIPTION OF THE DRAWINGS

FIG. 1 is a perspective view from the front of the mailbox.

FIG. 2 is a cross-section of the mail box along lines 2—2 of FIG. 1, showing the upper door closed and the rear access door open.

FIG. 3 is a cross section along lines 2—2 of FIG. 1, showing the upper door open and the rear access door closed.

FIG. 4 is a rear view of the mailbox.

DESCRIPTION OF THE PREFERRED EMBODIMENTS

Please refer to the accompanying FIGS. 1–4 where like numerals refer to like parts throughout the drawings. FIG. 1 illustrates the present invention in perspective. The box 10 defining an enclosed area to contain the deposited mail includes a bottom 11, front wall 12, a rear wall 13, two opposing side walls 14 and 15, and a top 16. The top 16 may have a rectangular cross-section, as shown, or may have a substantially semicircular or faceted cross-section. An upper door 17 is attached to the front wall 12 at pivot point 18. A locking lower door 19 allows access to the enclosed area. A flag or other signal means 20 may be attached on the exterior of the box to signal when outgoing mail needs to be picked up.

FIGS. 2 and 3 illustrate the incoming mail mechanism design that uses two cooperating elements, an upper door 17 and a wedge 32, to form a physical barrier that prevents access to the bottom of the box where the deposited mail rests. The upper door is formed from a first panel 21 and a second panel 22, attached to each other with a crosspiece 23. The edge of the first panel 21 is shaped to match the shape of the top 16 such that a weather-tight seal is formed. The edges may abut one another or may have overlapping lips that cooperate to form a weather-tight seal. Preferably the first panel 21 has a lip 24 that extends over and around the top, as shown in FIG. 1, although the lip may also fit within the top. The configuration of the first and second panels forms a convenient outgoing mail pocket 25. Of particular note, because the pocket is formed in the upper door, the pocket does not congest the opening or otherwise interfere with the deposition of mail. Deposited mail can be placed directly on the first panel, acting as a shelf, or may be tossed in through the wide opening created when the upper door is opened.

The upper door 17 swings from a vertical to horizontal position about pivot point 18, defining an arc 30 as shown. The upper door 17 pivots near its center axis at the pivot point 18 so that when it is opened, the bottom of the door travels upwards in an arc until it is in approximately a horizontal position within the box, thereby forming a shelf. At this horizontal position, the distal edge of the second panel 22 meets a wedge-shape block 32 at the back of the box so that a physical barrier exists, and the inside of the box cannot be accessed from the front. FIG. 1 shows the upper door in the closed position. FIG. 2 shows the door in a partially opened position.

FIG. 4 illustrates the box from a rear view. The lower door 19 allows access to the bottom of the box and the deposited mail. The lower door 19 has a lock 33 to prevent unauthorized persons from opening the door.

The objects of this invention are achieved through the aforementioned improvements. Although certain preferred embodiments have been shown and described, it should be understood that other embodiments and modifications that achieve these objects may be apparent to those of skill in the art and are within the scope of the appended claims.

I claim:

1. A mailbox comprising:

a) a box defining an enclosed area, the box comprising a front wall, a rear wall, two opposing side walls, a bottom and a top;

b) an upper door movable through an arc from a substantially vertical closed position to a substantially horizontal open position;

i) the upper door having a first panel with top and bottom edges and a second panel having proximal and distal edges, the bottom edge of the first panel attached between the proximal and distal edges of the second panel with a crosspiece, thereby forming an outgoing mail pocket;

ii) the upper door pivotally attached to the front wall near the crosspiece;

iii) the top edge of the first panel meeting the top to form a weather-tight seal;

c) a locking lower door pivotally attached to the rear wall;

d) a wedge-shaped projection inside the box, mounted at a level such that the nose of the wedge projects horizontally at least as far as the radius of the arc circumscribed by the distal edge of the second panel of the upper door such that at no degree of the upper door opening can the inside of the box below the nose of the wedge be accessed through the upper door.

2. A mailbox of claim 1 wherein the box, upper door and lower door are made of steel.

3. A mailbox of claim 1 or 2 wherein the top is of semicircular cross-section.

* * * * *